United States Patent [19]

Bohg et al.

[11] Patent Number: 4,517,538

[45] Date of Patent: May 14, 1985

[54] ELECTROMAGNETIC ROTARY ACTUATOR WITH ROCKING MOVEMENT, IN PARTICULAR FOR IMPACT PRINTERS

[75] Inventors: Armin Bohg, Weil-Neuweiler; Horst D. Matthaei, Waldenbuch; Kurt Hartmann, Calw Heumaden, all of Fed. Rep. of Germany

[73] Assignee: International Business Machines Corporation, Armonk, N.Y.

[21] Appl. No.: 545,562

[22] Filed: Oct. 26, 1983

[30] Foreign Application Priority Data

Nov. 5, 1982 [EP] European Pat. Off. ..... 82110213.4

[51] Int. Cl.[3] ..... H01F 7/14

[52] U.S. Cl. ..... 335/272; 335/274; 335/281

[58] Field of Search ..... 335/270, 272, 274, 276, 335/277, 279, 281

[56] References Cited

U.S. PATENT DOCUMENTS 3,278,875 10/1966 McDonough ..... 335/272

4,412,197 10/1983 Bohg et al. ..... 335/266 X

FOREIGN PATENT DOCUMENTS 1102811 2/1968 United Kingdom ..... 335/272

*Primary Examiner*—George Harris

*Attorney, Agent, or Firm*—E. Ronald Coffman

[57] ABSTRACT

An electromagnetic actuator for performing an individual stepping, switch or impact movement consists of an electromagnetic actuator and a pivoted or rocking armature moving. The rotational design of the electromagnetic actuator enables only one excitation coil to serve a plurality of magnetic gaps.

7 Claims, 10 Drawing Figures

Figure 1:
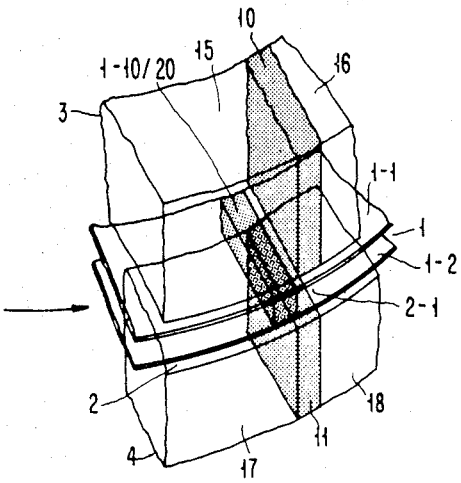

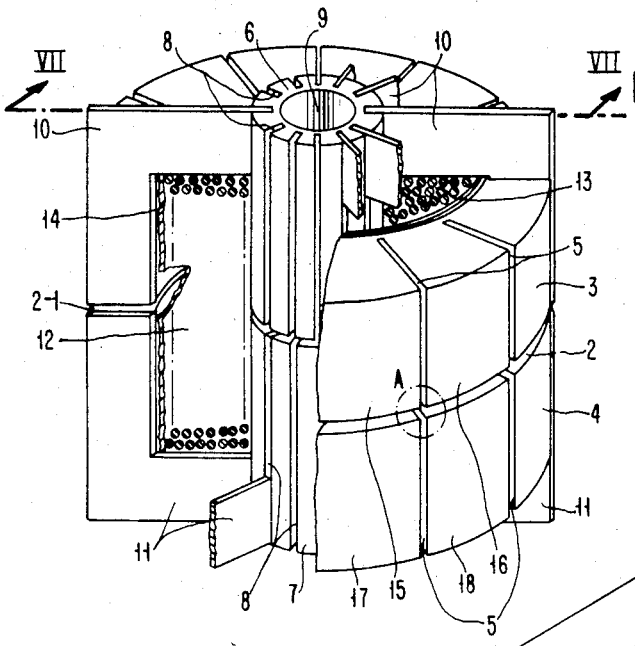
FIG. 3
FIG. 4
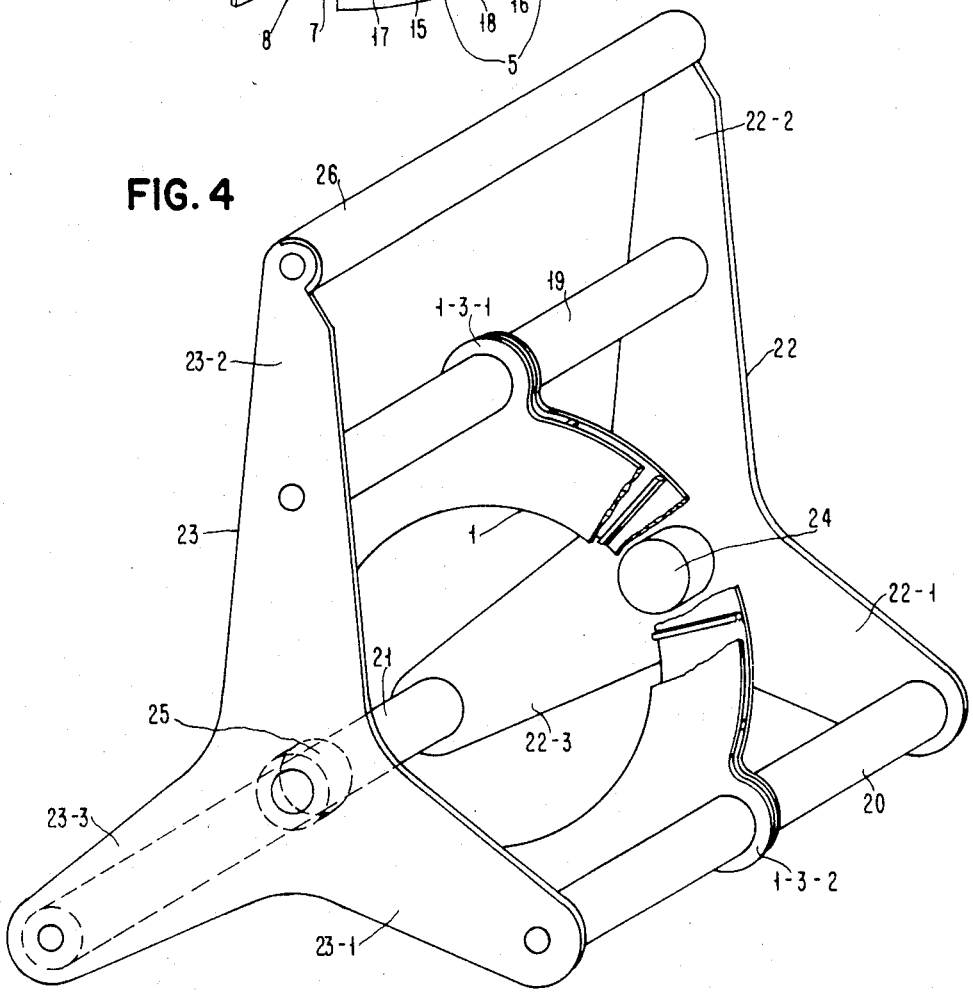

ELECTROMAGNETIC ROTARY ACTUATOR WITH ROCKING MOVEMENT, IN PARTICULAR FOR IMPACT PRINTERS

The invention concerns an electromagnetic rotary actuator with rocking movement which is particularly suitable for impact printers.

The basic physical function of this novel actuator is based on a principle such as that described in U.S. Pat. No. 4,371,857 or European patent application No. 80 103 387.9 which concern a high-speed, electromagnetically operated ram actuator, suitable in particular for impact printers. The actuator generally consists of substantially symmetrically structured magnetizable yoke halves with one or several excitation coils. Facing pole ends of the yoke halves form magnetic operating gaps which are aligned to each other. Between the magnetic operating gaps, a ram or armature is arranged which is shiftable in a plane aligned with these gaps. The cross-section of the ram, which may have a cylindrical or cuboid shape, is adapted to the area of the operating gaps. The ram comprises, for example, disk- or cuboid-shaped armature elements of magnetizable material, between which spacer elements of predominantly non-magnetizable material are arranged. The armature elements are geometrically shaped such that their volume is of the order of that of the operating gaps. In the original position of the ram, the armature elements in the non-excited state of the electromagnets are positioned substantially external to the operating gaps. Upon excitation of the electromagnet, they are pulled into the operating gaps, being accelerated in the process.

In arrangements of this kind, the ram moves in a straight line.

In the case of a yoke half pair, it is possible to provide only one yoke half with a coil or both halves with one coil each. If a ram is associated with several yoke half pairs, the number of coils required increases correspondingly.

Such ram assemblies acting in a straight line (linearly), thus have the following disadvantages: Each yoke half pair invariably requires two coils (one coil for each half) to prevent lateral forces during actuation. In print hammer banks with several adjacent ram assemblies, the overall width is limited by the lateral spacing of adjacent ram units.

Therefore, it is the object of the invention to provide an actuator which is based on the principle of a magnetizable armature element being pulled into the operating gap of an electromagnet, which requires only one excitation coil for a plurality of magnetic operating gaps, and which permits a greater overall width for the single actuator at a given lateral ram spacing.

This object, according to the invention, is accomplished by mounting the armature for rocking or oscillatory movement.

The electromagnetic rotary actuator with rocking movement, according to the invention, offers particular advantages in conjunction with impact printers, namely:

(1) The effective mass of the impact structure acting as a (print hammer) is only negligibly increased by the actuator, as the latter is positioned much closer to the axis of rotation than the actual impact element.

(2) By alternately using vertically positioned and suspended actuator systems, the overall width of an actuator unit may be twice as large as the lateral spacing of the rotary actuator units.

(3) Instead of two flat coils (ram actuators with flat coils are described in the European Application No. 82 101 865.2, only one cylindrical coil is required.

Figure 2:
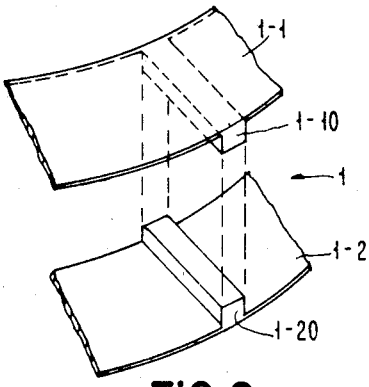
Figure 6:
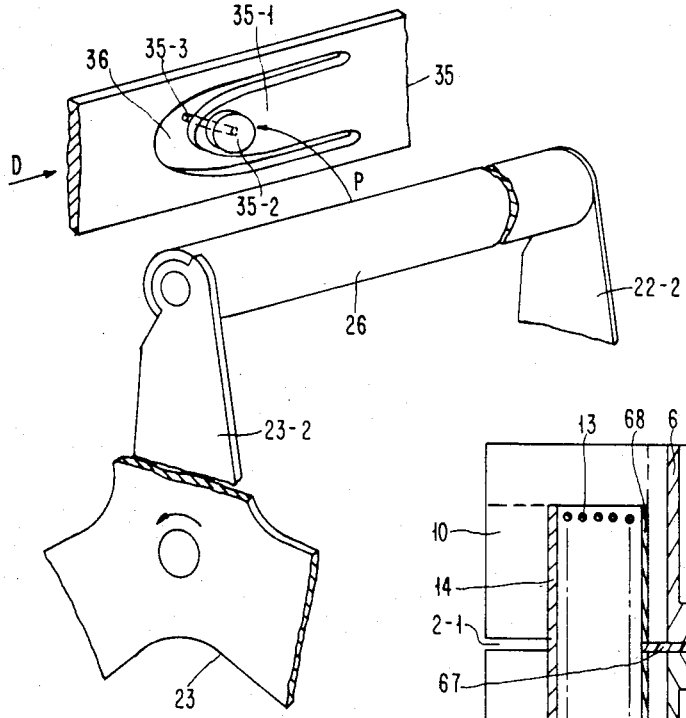
Figure 10:
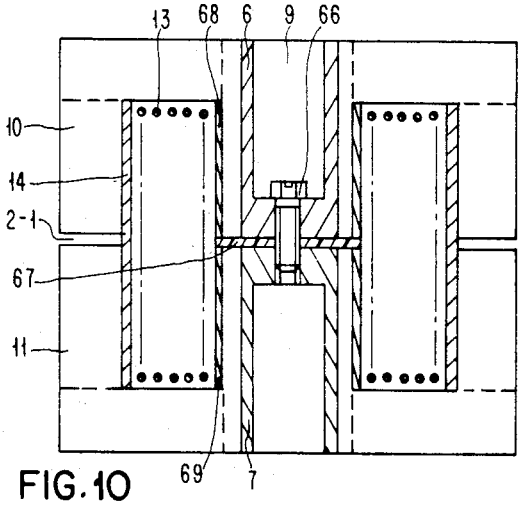
Figure 5:
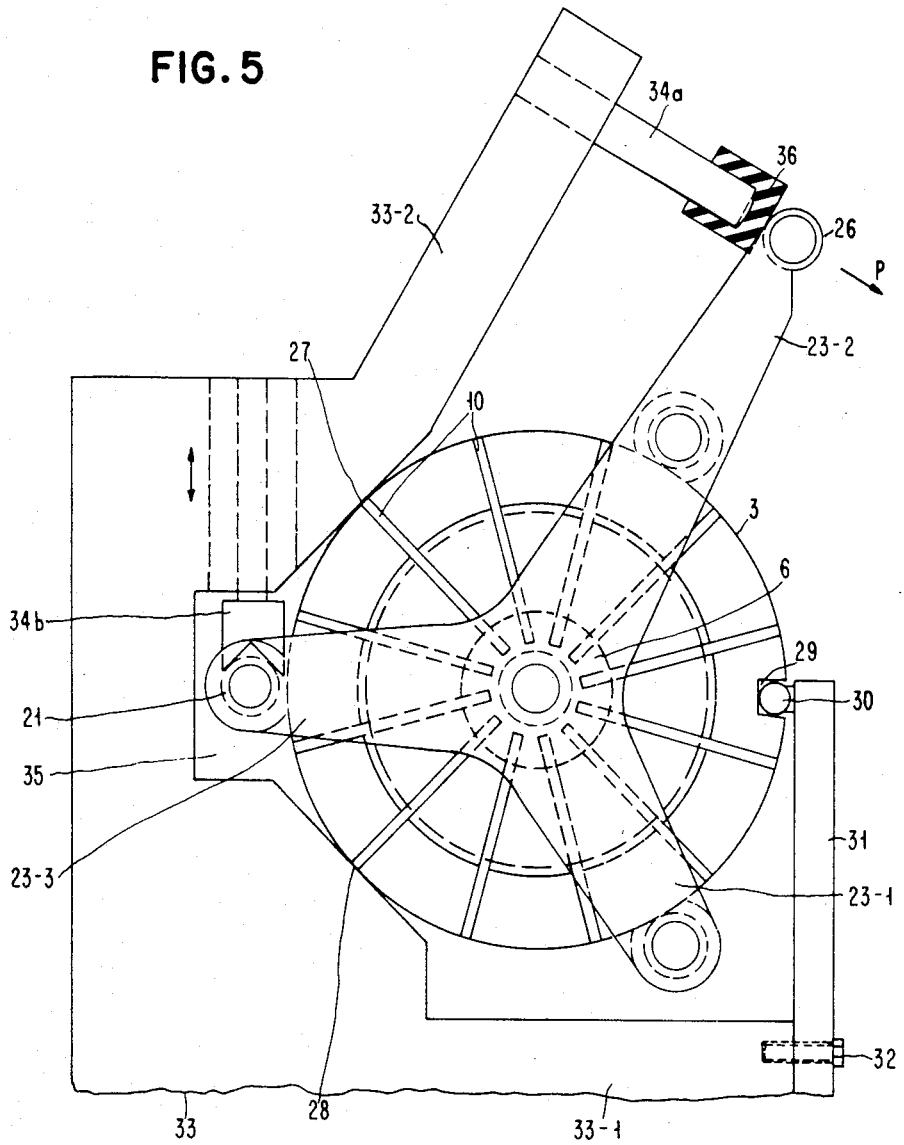
Figure 7:
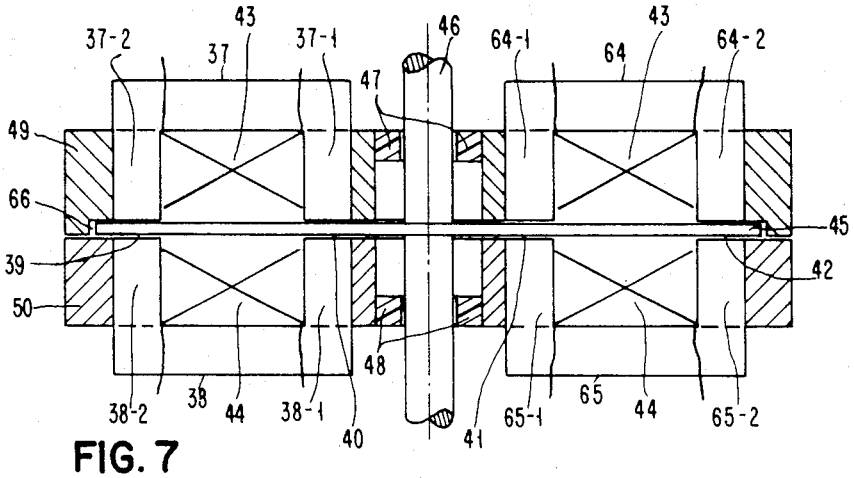
Figure 8:
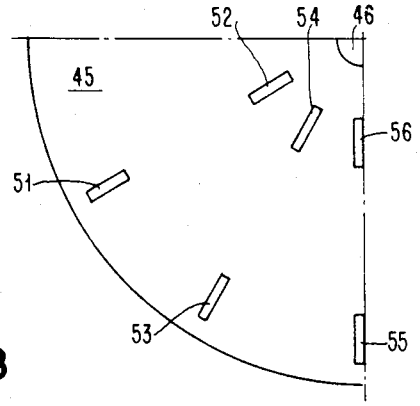
Figure 9:
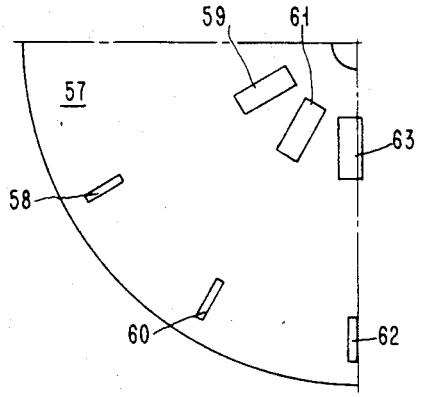

An illustrative embodiment of the invention is described in detail below with reference, of which:

FIG. 1 is a perspective view of the primary elements of our invention, showing a a disk ring with armature bars, each of which is pulled into a magnetic operating gap positioned between two yokes, FIG. 2 is a schematic, exploded view of a disk ring (with armature bars) made up of two partial halves, FIG. 3 is a schematic perspective view of the electromagnetic actuator with an upper and a lower outer ring and an upper and a lower inner ring with radial slots for accommodating a plurality of yokes which are excited by a single coil common to all of them, FIG. 4 is a schematic perspective view of the disk ring (extending between the upper and the lower outer ring of FIG. 3), the outside of which is connected to a bar plate assembly, FIG. 5 is a schematic lateral view of a fixture for accommodating the electromagnetic actuator and the pivotable bar plate assembly, connected to the disk ring, for performing a rocking movement, FIG. 6 is a schematic, perspective, view of an application using the rocking movement in an impact printer, FIG. 7 is a schematic sectional representation of a ring-shaped electromagnetic actuator and an axle-linked rotary disk for performing a rotary step, FIG. 8 is a schematic, detail, plan view of a rotary disk (for use in an arrangement according to FIG. 7) with armature bars radially positioned on two concentric circles, FIG. 9 is a schematic, detail, plan view of another rotary disk with armature bars radially positioned on one concentric circle and with recesses positioned on another concentric circle, FIG. 10 is a schematic sectional view taken along plane VII—VII in FIG. 3.

FIG. 1 is a perspective, diagrammatic, detail representation of a disk ring 1 with an armature bar 1-10/20 which is pulled into a magnetic operating gap 2-1 positioned between two magnetic flux-conducting yokes 10, 11. The arrangement consists of an upper outer ring 3 and a lower outer ring 4. Outer rings 3 and 4 are fixed and spaced from each other, forming a gap 2. A disk ring 1, which is freely movable in the direction of the arrow, is suspended in this gap. The disk ring moves about its axis of rotation (not shown) in the ring plane. This movement is effected by the interaction of the magnetic field in the magnetic operating gap 2-1 and the magnetizable armature bar. The magnetic operating gap is positioned between the pole ends of two facing yokes 10 and 11. One yoke 10 is arranged in the upper outer ring 3 and the other yoke 11 in the lower outer ring 4. The yokes 10 and 11 are electromagnetically excited by a cylindric coil (not shown in FIG. 1) encompassing the axis of rotation of the disk ring. Outer rings 3 and 4 are structured such that the yokes in radial alignment are positioned between the magnetically non-conductive outer ring segments 15, 16, 17, 18. The outer ring segments adjacent to the yoke 10 in the upper outer ring 3 are designated as 15 and 16 and those adjacent to the yoke 11 in the lower outer ring as 17 and 18. The disk ring 1 consists of a radially aligned armature bar 1-10/20 which has roughly the same dimensions as the magnetic operating gap 2-1 between the pole ends of the yokes 10 and 11. Disk portions of predominantly non-magnetizable material are positioned to the left and right of this armature bar. Upon excitation of the yokes 10 and 11, leading to the formation of a magnetic operating gap between their pole ends, armature bar 1-10/20 is pulled into this magnetic operating gap 2-1 and accelerated in the process. As will be described in detail further on, this movement is utilized for generating a rocking movement, as may be used, for example, in impact printers to generate an image. FIG. 1 shows only one magnetic operating gap 2-1 and one associated armature bar 1-10/20. In actual fact, a plurality of magnetic operating gaps, each associated with one armature bar, are formed between the upper outer ring 3 and the lower outer ring 4.

Ideally, the individual armature bars are separated from each other by non-magnetizable disk ring segments. The production of disk 1 may be facilitated, however, by providing a structure which is such that the individual armature bars are not separated from each other by segments of non-magnetizable material but by thin, continuous sheet metal bridges interconnecting, and made of the same material as, the armature bars.

FIG. 2 is a schematic, exploded detail view showing the formation of the disk ring from two partial halves 1-1 and 1-2.

The halves 1-1 and 1-2 comprise parts 1-10 and 1-20, respectively, for forming the actual armature bar 1-10/20, as well as a thin continuous disk ring plate of the same material as the armature bar. The disk ring plate and armature bar parts 1-10 and 1-20, respectively, form, for example, the common partial halves 1-1 and 1-2, which are obtained by etching. For forming the disk ring 1, the two partial halves 1-1, 1-2 are welded together according to FIG. 2. It has been found that the function of the arrangement is not substantially influenced by the fact that the disk ring plates, interconnecting the armature bars, are made of magnetizable material. These plates are much thinner than the actual armature bar. The production of the partial halves 1-1 and 1-2 is extremely simple and inexpensive in addition, a disk ring 1 thus produced has the advantage that its surface is free from butt joints, so that it is not necessary to surface grind the interface area between the disk ring and the pole ends of the yokes to assure freedom of movement.

FIG. 3 is a schematic, perspective representation of the electromagnetic actuator with an upper and a lower outer ring and an upper and a lower inner ring with radial slots for accommodating yokes which are excited by a coil common to all of them.

The detail area designated as A in FIG. 3 represents the region from which the section of FIG. 1 is taken. The outer ring segments 15, 16, 17 and 18 are identical in FIGS. 3 and 1. For clarity's sake, disk ring 1 and yokes 10 and 11 (FIG. 1) have been omitted in FIG. 3 and in the region of detail A. However, the yokes are shown elswewhere in FIG. 3.

The electromagnetic actuator consists of an upper magnetizable inner ring 6 and a lower magnetizable inner ring 7, as well as of an upper outer ring 3 and a lower outer ring 4. Inner and outer rings have slots pointing radially outwards. The slots of the upper and the lower inner ring are designated as 8 and those of the upper and the lower outer ring as 5. Inner rings 6 and 7 are spaced from each other by a magnetizable spacer 67 which is illustrated in FIG. 10 but not in FIG. 3. The inner rings are higher than the outer rings associated with them. The free ends of the inner rings are provided with a bore 9 for accommodating guide pins 24, 25 in FIG. 4. As previously described in conjunction with FIG. 1, the upper and the lower outer ring 3 and 4 are spaced from each other, forming a gap 2 (in which disk ring 1 is positioned). The upper part of the slots 8 in the upper inner ring, the lower part of the slots 8 in the lower inner ring, and the slots 5 of the outer rings serve to accommodate U-shaped yokes 10, 11.

The yokes may be structured in various ways. It is essential, however, that for an operating gap, formed between the pole ends of two facing yokes 10 and 11, the yoke circuit is closed, except for this operating gap (FIG. 10). In other words, in addition to the yokes 10 and 11 and the desired operating gap 2-1, the magnetic circuit must not comprise a further air gap.

For this purpose, one leg of the U-shaped yokes is accommodated almost completely by slots 5 of the outer rings, while the other leg is accommodated by the slots of the inner rings. The inner and the outer rings are spaced sufficiently far apart, accommodating a cylindric coil 13 in the interstitial space 12 thus obtained. For simplicity's sake, the two terminals for this coil are not shown.

The yokes connecting the upper inner ring 6 and the upper outer ring 3 are designated as 10 and those connecting the lower inner ring 7 and the lower outer ring 4 as 11. A sleeve 14, acting as a spacer for the yokes 10 and 11, is arranged between coil 13 and the inside of the upper and the lower outer ring.

The arrangement of FIG. 3 can be easily assembled by slipping sleeve 14 and coil 13 on an upper partial unit 3, 6, 10 and by subsequently adding the lower partial unit 7, 4, 11. The slots of the inner and the outer rings are aligned to, and uniformly spaced from, each other. The yokes are made of magnetizable material, preferably soft-iron. Upon excitation of coil 13, magnetic operating gaps 2-1 (FIG. 1) are formed between the pole ends of the yokes in gap 2 (FIG. 1). The inner rings 6 and 7 are made of magnetizable material and the upper and the lower outer rings of non-magnetizable material, preferably brass.

Further design details of the electromagnetic actuator of FIG. 3 are shown in FIG. 10. FIG. 10 is a sectional view taken along plane VII—VII of FIG. 3. This sectional view serves to show more clearly the assembly of the electromagnetic actuator and a yoke circuit with an operating gap. As previously mentioned, the operating gap 2-1 is formed between the pole ends of the U-shaped yokes 10 and 11. The legs of these yokes are positioned in slots of the outer and the inner rings 6, 7. A magnetizable spacer 67 is arranged between the upper inner ring 6 and the lower inner ring 7. The height of this spacer 67 determines the height of the operating gap 2-1. The upper partial unit 3, 6, 10 and the lower partial unit 7, 4, 11 (FIG. 3) are held together by a suitable screw connection 66 (FIG. 10). As previously mentioned, sleeve 14 acts as a spacer for yokes 10 and 11. The narrower legs of the U-shaped yokes, which are positioned in the slots of the upper and the lower inner ring, are held in place by a sleeve 68 or 69 which is forced on to the upper inner ring 6 and the lower inner ring 7, respectively. For simplicity's sake, sleeves 68 and 69 are not shown in FIG. 3. Similar to FIG. 3, the upper bore of inner ring 6 for accommodating the pin 24 is designated as 9 in FIG. 10. The coil positioned between sleeve 14 and inner sleeves 68 and 69 is again designated as 13. The magnetizable spacer 67 as well as the upper inner ring 6 and the lower inner ring 7 are made of soft-magnetic material. In order to ensure a uniform flux density, the sum of the areas of all operating gaps 2-1 correponds roughly to the area of spacer 67. As the upper inner ring 6, the lower inner ring 7 and the spacer 67 are made of soft-magnetic material, the legs of the U-shaped yokes positioned in the slots of the upper and the lower inner ring may be narrower than the outer legs forming the operating gap 2-1.

FIG. 1 shows how disk ring 1 (not shown in FIG. 3) is positioned in gap 2 between the upper and the lower outer ring (FIG. 3). Disk ring 1 comprises, in radial alignment, a plurality of armature bars 1-10, 20, each of which is associated with one magnetic operating gap 2-1. In the non-excited state of the electromagnet, one such magnetizable armature bar is positioned external to each magnetic operating gap into which it is pulled upon excitation of the electromagnet. This movement is used to generate an actuating (rocking) movement, preferably for impact printers. FIGS. 1 and 3 show that all magnetic operating gaps together with their associated armature bars participate in that movement. The actuating force of the disk ring, which is produced by its armature bars being pulled into the associated operating gaps, is the higher the more magnetic operating gaps there are. However, a higher actuating force leads to a higher acceleration when the disk ring moves from its inoperative to an operative position, and thus to a higher speed which is necessary in particular for impact printers for achieving high print speeds. The disk ring is moved by each armature bar being pulled into the associated magnetic operating gap and accelerated. During this process, the armature bar continues to move beyond the magnetic operating gap, particularly if the magnetic field is not switched off in time. How the disk ring is restored to its original position for renewed actuation is described elsewhere.

In order to convert the actuating movement of the freely movable disk ring in gap 2 into an externally effective rocking movement, special design measures are provided.

These are shown more clearly in FIG. 4 which is a schematic perspective representation of the disk ring (positioned between the upper and the lower outer ring) having its outside connected to a bar plate assembly which serves to accommodate the electromagnetic actuator.

As previously mentioned in connection with FIG. 1, armature disk ring 1, which is inside gap 2 of the electromagnetic actuator (FIG. 3) when the electromagnet is excited, performs a single rotary step movement. FIG. 4 shows the design measures that are used to transform this rotary step movement of the freely movable armature disk ring 1 into a rocking movement. In impact printers, for example, such a rocking movement may be used for character printing. The armature disk ring positioned in gap 2 of the electromagnet actuator (FIG. 3) has its top part guided by the bottom side of the upper outer ring 3 and its bottom part by the top side of the lower outer ring 4. Sleeve 14 prevents the armature disk ring from becoming displaced towards the inside in the direction of coil 13 or towards the outside in the opposite direction. According to FIG. 4, the armature disk ring 1 is provided with three external disk ring lugs 1-3-1 and 1-3-2 (the third one not being shown) for accommodating one bar each 19, 20, 21. The disk ring lugs and the bars connected to them are positioned outside the electromagnetic actuator shown in FIG. 3. The bars 19, 20, 21, positioned parallel to, and at uniform spacings from, each other at the circumference of the armature disk ring, extend parallel to the assumed axis of the inner or the outer rings. The bars 19, 20, 21 have their ends permanently connected to plates 22, 23 which are star-shaped components with three legs. In FIG. 4, the legs of the front plate 23 are designated as 23-1, 23-2, 23-3 and those of the rear plate 22 as 22-1, 22-2 and 22-3. Legs 23-2 and 22-2 are extended. An impact bar 26 is arranged between the ends of these extended legs. As will be described in greater detail below, this impact bar 26 is used to perform the rocking movement which occurs in response to a rotary step movement of the armature disk ring 1. In the center part of the plates 22 and 23, pins 24 and 25, directed towards the inside, are arranged which are aligned to each other. These pins serve to accommodate the electromagnetic actuator, as is shown in FIG. 3. Pin 25 serves to accommodate the bore 9 of the electromagnetic actuator, whereas pin 24 serves to accommodate the relevant bore (not recognizable in FIG. 3) in the lower inner ring 7. For clarity's sake, the electromagnetic actuator (FIG. 3) and the bar plate assembly according to FIG. 4 are shown separately. It will be seen how disk ring 1 (FIG. 4) positioned in gap 2 of the electromagnetic actuator is connected to the bar plate assembly lying outside and quasi-surrounding the electromagnetic actuator. In the case of a rotary step movement of the disk ring, the bar plate assembly (FIG. 4) is forced to follow the ring movement and to perform a rotary step movement about the axis extending through pins 24 and 25. The impact bar 26 between the extended legs 23-2, 22-2 of the plates 23 and 22 follows this rotary step movement, performing a rocking movement. This necessitates, however, that the electromagnetic actuator be retained in a fixed position which allows the defined operating sequence of the bar plate assembly.

The separate representation of the electromagnetic actuator in FIG. 3 and the bar plate assembly in FIG. 4 is not meant to imply that the two component groups are initially separately assembled. It merely serves to clarify the operation of the two component groups. For combining the electromagnetic actuator and the bar plate assembly, it should be borne in mind that the assembled electromagnetic actuator comprises the armature disk ring 1 and the bars 19, 20 and 21 fixed to it. After the electromagnetic actuator has been assembled, taking into account the step of positioning the armature disk ring 1 with the bars 19, 20, 21 in gap 2, the bars 19, 20, 21 are subsequently fixed to the plates 22, 23, adding the impact bar 26.

FIG. 5 is a schematic side view of a fixture 33 serving to accommodate the electromagnetic actuator (FIG. 3) and the bar plate assembly (FIG. 4) for performing a rocking movement. It is assumed that the electromagnetic actuator (FIG. 3) and the bar plate assembly (FIG. 4) have been previously combined. FIG. 5 shows how the two combined units interact with the fixture for performing a rocking movement. The movable part is the bar plate assembly, and the fixed part is the electromagnetic actuator. The electromagnetic actuator is fixed at three points to the fixture, thus holding the latter in place. The fixture essentially consists of two legs 33-2 and 33-1 which with regard to their mutual position may be compared to the legs of an obliquely printed L. The electromagnetic actuator is forced at two points 27 and 28 against one of the legs 33-2 which is provided with a recess 35. The electromagnetic actuator has a recess 29 in the peripheral area of an outer ring segment for accommodating an adjusting pin 30, whose upper end is fixed to a holding plate 31 which by means of a connecting element 32, such as a screw, is connected to the lower leg 33-1 of the fixture 33. Thus, the electromagnetic actuator is held in place at three points. For performing a rocking movement in the direction of arrow P, the bar plate assembly is provided at two points with elements limiting the operating path. The original position is defined by a stop pin 34*a*, whose upper end is provided with a material piece 36 for damping the movement. The stop pin 34*a* is fixed to the upper end of leg 33-2 of the fixture 33. Its damping stop element 36 acts on the impact bar 26 which is arranged at the extreme end between legs 23-2 and 22-2 (FIG. 4). In the original position, the impact bar 26 rests against the stop 36 from where it moves when performing a rocking movement in the direction of arrow P. The strake of the rocking movement is limited by the restoring element 34*b*. This restoring element 34*b* is arranged in the recess 35 of the fixture; it may be, for example, an element which is resilient in the direction of the double arrow (e.g., a coil spring) and which acts on the bar 21 positioned between the legs 23-3 and 22-3 of the plates 23 and 22 (FIG. 4). When a rocking movement is performed in the direction of arrow P, bar 21 moves upwards against the force of the restoring element up to a point from where said restoring element returns the bar plate assembly to its original position in the direction opposite to that of arrow P. The original position is defined by stop element 36 for the impact bar 26.

FIG. 6 is a schematic perspective detail representation of the rocking movement for impact printers. In connection with FIG. 5 it has been explained how a rocking movement is performed in the direction of arrow P, and how the bar plate assembly performs a single rotary step movement about its axis extending through the pins 24, 25. For this purpose, impact bar 26, positioned between the extended legs 23-2 and 22-2, moves in the direction of arrow P, and after the rocking movement has been performed, the bar plate assembly is returned by restoring element 34*b*. According to FIG. 6, this rocking movement can be utilized for impact printers, using, for example, a print element band 35 moving in the direction of arrow D. This print element band has a cut-out 36 into which a flexible tongue 35-1 protrudes which is made of the same material as the band. On one side of this tongue a print element 35-3 is arranged for generating a dot-shaped image; the other side is provided with an impact-receiving element 35-2. When a rocking movement is performed, the impact bar 26 hits against this element 35-2, and print element 35-3 moves in an extended direction of P for generating a print image. This movement is supported by the resilient properties of the tongue 35-1 which can be readily deflected in the direction to print.

The embodiment described above is not only suitable for impact printers but also for applications requiring a rocking movement of relatively great force and velocity. The force may be enhanced by providing a great number of magnetic operating gaps, thus increasing the acceleration and the rocking velocity, whose magnitude is high if the bar plate assembly consists of relatively light parts. Assemblies of this kind may be used, for example, for the paper feed or ribbon drive in printers, etc.

If the rotary actuators according to the invention are used in impact printers, it is no problem to keep their width small, in order to achieve a high packing density in (print hammer banks).

It is also possible for the rotary actuators to be alternately suspended and vertically positioned, with the impact bars of the various actuators being in alignment with each other.

While the embodiment illustrated in FIGS. 3, 4 and 5 refers to an arrangement in which the rotary step actuating movement of the disk ring is transferred to a bar plate assembly connected to its periphery, FIG. 7 shows an embodiment wherein the armature bars are arranged on a disk 45 permanently connected to an axis of rotation 46 for performing a rotary actuating step. According to FIG. 8, this disk 45 carries magnetizable armature bars 51 to 56 arranged along two tracks which are concentrically aligned about axle 46 and which are in radial alignment with each other. These armature bars 51 to 56 are associated with magnetic operating gaps of an electromagnetic actuator. This electromagnetic actuator is formed by a plurality of U-shaped yoke pairs. In FIG. 7, for example, such a yoke pair is formed by the U-shaped yokes 37 and 38 and 64 and 65, respectively. The pole ends of such a pair of U-shaped yokes face each other, forming magnetic operating gaps, with the bases of the yokes being radially aligned. The various yokes are embedded in one concentric holding means each 49 or 50 which extend concentrically to axle 46. The holding means 49 and 50 are assembled such that a gap 66 remains inside them for accommodating the disk 45. The parts of holding means 49 and 50, which are arranged close to the axle, are each provided with one bearing 47, 48. The axle is freely movable in this bearing and the holding means is permanently connected to the electromagnetic actuator. The excitation coil of the electromagnetic actuator is designed in two parts as an annular coil, the upper annular coil 43 being positioned in the aperture of the upper U-shaped yokes and in a concentric recess in the holding means 49. The lower annular coil is positioned in the aperture of the lower yokes (e.g., 38 and 65) and a concentric recess in the holding means 50. The coil is designed in two parts, as disk 45 is positioned between the coil parts.

In FIG. 7 the legs of the U-shaped yoke 37 are designated as 37-1 and 37-2 and the legs of the U-shaped yoke 38 as 38-1 and 38-2. Both yokes face each other such that one operating gap each 39 or 40 is formed between their pole ends. Operating gap 40 has associated with it one armature bar on the inner concentric track of disk 45 (see FIG. 8), and the outer magnetic operating gap 39 has associated with it one armature bar on the outer concentric track of disk 45. This applies in analogy to the facing U-shaped yokes 64 and 65 on the right-hand side in FIG. 7. The legs of the yokes 64 are designated as 64-1 and 64-2 and those of the yoke 64 as 65-1 and 65-2. The legs 64-1 and 65-1 face each other, forming a magnetic operating gap 41. The facing legs 64-2 and 65-2 form a magnetic operating gap 42. The operating gap 41 is again associated with an armature bar of the inner concentric track according to FIG. 8 and the operating gap 42 with an armature bar of the outer concentric track of disk 45. It is obvious that only the radially aligned armature bars on the inner and the outer track of disk 45 may be associated with the inner and the outer magnetic operating gap of a pair of U-shaped facing yokes.

The operation of the arrangement of FIG. 7 need not be separately described in view of the description given with regard to FIGS. 3, 4 and 5. Before the electromagnet is excited, an armature bar is positioned external to each magnetic operating gap, being pulled into the latter upon excitation of the electromagnet. During this process, armature disk 45 rotates, causing axle 46, which is permanently fixed to it, to perform a rotary actuating step. For simplicity's sake, technical details regarding the determination of the original position of the armature disk and of an element for returning the armature disk to its original position upon completion of a rotary actuating step have been omitted. The rotary movement is preferably limited and adjusted by the axle. Suitable stops and restoring elements are not essential to the invention and are obvious to those skilled in the art, so that they need not be described in detail.

FIG. 7 may be modified to the effect that the inner legs of the yoke pairs close to the axle are produced to be continuous. In such a case, disk 57 (FIG. 9) merely has to be provided with a track for the armature bars 58, 60, 62. The continuous legs (assuming that legs 37-1 and 38-1 of yoke pair 37 and 38 are connected to each other) must have adequately large recesses (59, 61, 63) along an inner concentric track of disk 57. These recesses, in addition to being adequately large so as to permit the connected legs to pass the circular disk, must allow a free rotary actuating movement of the armature disk and be provided with means for assembly.

We claim:

1. An electromagnetic actuator comprising an electromagnetic yoke assembly including magnetically permeable means forming at least one magnetizable path including a gap, coil means for selectively magnetizing said path, and armature means including a magnetizable element dimensioned to move into and out of said gap, wherein the improvement comprises:

means supporting said yoke assembly and said armature means for relative movement about an axis of rotation, and means for restraining relative movement of said yoke assembly and said armature to a small angle of rotation.

2. An electromagnetic actuator as defined in claim 1 wherein said armature means comprises a plurality of magnetizable elements which are spaced angularly about said axis of rotation and wherein said yoke assembly provides a like plurality of magnetizable paths having individual gaps spaced angularly about said axis of rotation for cooperation with said plurality of elements.

3. An electromagnetic actuator as defined in claim 2 wherein said coil means comprises a single coil formed concentrically to said axis and being common to all said paths.

4. An electromagnetic actuator as defined in claim 2 wherein said magnetically permeable means comprises a central core portion that is concentric with said axis and a plurality of radially extending yoke arm portions magnetically coupled with said central core portion for providing said plurality of gaps.

5. An electromagnetic actuator as defined in claim 1 further comprising means for restraining one of said yoke assembly and armature means from relative movement and means connecting the other of said yoke assembly and armature means to an output member to be actuated.

6. An electromagnetic actuator as defined in claim 5 wherein said output member comprises a hammer for impacting a print element aligned therewith.

7. An electromagnetic actuator as defined in claim 1 wherein said magnetizable path includes a pair of radially spaced gaps and said armature means includes a pair of radially spaced magnetizable elements dimensioned to respectively move into and out of said radially spaced gaps.

* * * * *